US009907380B2

(12) United States Patent
Reh et al.

(10) Patent No.: US 9,907,380 B2
(45) Date of Patent: Mar. 6, 2018

(54) LUGGAGE ARTICLE WITH DISPLAY AND COMMUNICATION SYSTEM FOR LUGGAGE ARTICLES

(71) Applicant: Airbus Operations GmbH, Hamburg (DE)

(72) Inventors: Jan Reh, Hamburg (DE); Peter Sander, Bremen (DE); Peter Leopold Pirklbauer, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 1142 days.

(21) Appl. No.: 14/085,039

(22) Filed: Nov. 20, 2013

(65) Prior Publication Data

US 2014/0151173 A1 Jun. 5, 2014

Related U.S. Application Data

(60) Provisional application No. 61/731,504, filed on Nov. 30, 2012.

(30) Foreign Application Priority Data

Nov. 30, 2012 (EP) ..... 12195084

(51) Int. Cl.
*G08B 13/14* (2006.01)
*A45C 13/42* (2006.01)
(Continued)

(52) U.S. Cl.
CPC ..... *A45C 13/42* (2013.01); *A45C 5/03* (2013.01); *A45C 11/00* (2013.01); *A45C 13/18* (2013.01); *A45C 2011/003* (2013.01)

(58) Field of Classification Search
CPC ... A45C 13/42; A45C 13/00; A45C 2005/037; G01G 19/58
(Continued)

(56) References Cited

U.S. PATENT DOCUMENTS 6,476,718 B1 11/2002 Cartwright et al.
7,535,358 B2 5/2009 Crider et al.
(Continued)

FOREIGN PATENT DOCUMENTS

CN 201790170 * 4/2011
CN 201806118 U 4/2011
(Continued)

OTHER PUBLICATIONS

State Intellectual Property Office of the Peoples' Republic of China, Office Action for Chinese Patent Application No. 201310628662.9 dated Jan. 26, 2015.
(Continued)

*Primary Examiner* — Phung Nguyen
(74) *Attorney, Agent, or Firm* — Lorenz & Kopf, LLP

(57) ABSTRACT

A luggage article is provided. The luggage article includes a shell, an electronic processing module integrated with the shell, and an electronic display coupled to the electronic processing module and arranged on an outer surface of the shell. The processing module is configured to control the display to display information items to a user of the luggage article. The luggage article may be configured to display itinerary or travel related information on the display under the control of a user of the luggage article.

20 Claims, 1 Drawing Sheet

(51) Int. Cl.
*A45C 5/03* (2006.01)
*A45C 11/00* (2006.01)
*A45C 13/18* (2006.01)

(58) Field of Classification Search
USPC ..... 340/571, 572.1–572.9, 691.6, 815.4
See application file for complete search history.

(56) References Cited

U.S. PATENT DOCUMENTS

| | | | | |
|---|---|---|---|---|
| 7,626,505 | B2 | 12/2009 | August et al. | |
| 2005/0217904 | A1* | 10/2005 | Hughes | A45C 15/00 177/245 |
| 2006/0032687 | A1 | 2/2006 | Park et al. | |
| 2007/0083921 | A1* | 4/2007 | Parris | A45C 5/14 726/9 |
| 2007/0107947 | A1 | 5/2007 | Truong | |
| 2008/0303637 | A1 | 12/2008 | Gelbman et al. | |
| 2010/0018088 | A1 | 1/2010 | Rajpal | |
| 2010/0325060 | A1* | 12/2010 | McIntosh | E05B 67/383 705/333 |
| 2012/0098642 | A1 | 4/2012 | Krawczewicz et al. | |
| 2015/0292936 | A1* | 10/2015 | Sheikh | A45C 5/03 190/115 |

FOREIGN PATENT DOCUMENTS

| | | | |
|---|---|---|---|
| CN | 201905381 | U | 7/2011 |
| DE | 202004006159 | U1 | 6/2004 |
| GB | 2459288 | A | 10/2009 |
| WO | 2010127404 | A1 | 11/2010 |

OTHER PUBLICATIONS

European Searching Authority, European Search Report for 12195084.4 Dated Jun. 18, 2013.

* cited by examiner

LUGGAGE ARTICLE WITH DISPLAY AND COMMUNICATION SYSTEM FOR LUGGAGE ARTICLES

CROSS-REFERENCE TO RELATED APPLICATIONS

This application claims priority to U.S. Provisional Patent Application No. 61/731,504, filed Nov. 30, 2012, and to European Patent Application No. 12 195 084.4, filed Nov. 30, 2012, which are each incorporated herein by reference in their entirety.

TECHNICAL FIELD

This application pertains to a luggage article with a display and a communication system for luggage articles.

BACKGROUND

Luggage items may be used to contain, safeguard and protect personal belongings, appurtenances or paraphernalia by way of bundling goods within compartment boundaries in their inside. A challenge with luggage items is the association and concomitant dynamic allocation to its owner, particularly during travel modes where a temporary separation of travelling owner and luggage items is desired or even mandatory, such as airbound travel.

Conventionally, paper tags are used to label luggage items temporarily, enabling personnel charged with handling luggage items during travel to re-associate the luggage items to their respective owners. In recent years, RFID solutions have been used to improve the identification and allocation procedures of luggage items, in particular in the handling processes at airports to assure in-time delivery and routing.

U.S. Pat. No. 6,476,718 B1 discloses a traceable luggage system for luggage bags comprising a microchip tagged to the luggage bag for uniquely identifying the luggage bag.

U.S. Pat. No. 7,535,358 B2 discloses an electronic luggage for GPS tracking luggage and monitoring the state of the luggage.

U.S. Pat. No. 7,626,505 B2 discloses an RF tag attachable to travel bags for locating and tracking the travel bag during its shipment by providing owner's identification, destination and similar pedigree information about the travel bag.

U.S. Patent Publication No. 2012/0098642 A1 discloses a battery less luggage tag having UHF and RFID capabilities and a bi-state display.

U.S. Patent Publication No. 2008/0303637 A1 discloses an electronic-ink based RFID tag for attachment to a consumer item having graphical indicia.

The document GB 2459288 B discloses a suitcase fitted with an electronic device in an outer compartment of the suitcase.

U.S. Patent Publication No. 2010/0325060 A1 discloses an electronic baggage tracking device having a display displaying destination indicia of the tracked piece of baggage.

Splitting of travelling routes of a travelling person and their respective luggage items may result in improved travel organization and efficiency. Especially for luggage items there is an increasing need for the luggage item itself to be able to "communicate" with its surroundings and to influence its own handling processes in order to optimize the transportation of the luggage item by transportation service providers.

In addition, other objects, desirable features and characteristics will become apparent from the subsequent summary and detailed description, and the appended claims, taken in conjunction with the accompanying drawings and this background.

SUMMARY

According to various aspects of the present disclosure, a luggage article comprises a shell, an electronic processing module integrated with the shell, and an electronic display coupled to the electronic processing module and arranged on an outer surface of the shell, wherein the processing module is configured to control the display to display information items to a user of the luggage article.

According to another of various aspects of the present disclosure, a communication system for luggage articles according to various aspects comprises a management platform configured to communicate with the electronic processing module and to control the electronic processing module to display information items on the display of the luggage articles.

One main idea of the present application is to provide an "intelligent" piece of luggage that is able to communicate with its surroundings by means of displaying situation dependent information items regarding its travel status. To that end, an electronic device is integrate into the luggage article in order to be able to directly transfer application data to and from the luggage article and to interact with the luggage article for multiple purposes.

An advantage of such a luggage article is the possibility to enable remote labelling, tracking and re-rerouting of the luggage article. This enhances the comfort of the user and minimizes the possibilities of wrong handling or routing of the luggage article.

Furthermore, an advantage is the possibility to remotely lock the luggage article and to check its current travel status, for example via a smartphone app. This enhances the controlling experience and the safety of the contents of the luggage article.

The luggage article of the application may be easily personalized to a user in order to uniquely identify the luggage article. Moreover, the luggage articles may communicate among each other, if desired, i.e. the interaction possibilities with the surroundings of the luggage articles are advantageously enhanced.

Moreover, the display may be commercially exploited as advertising space for subsidies or for personalization in order to enrich the user experience and to facilitate the optical traceability of the luggage article.

According to one of various embodiments of the luggage article, the electronic processing module further comprises a processing unit, and a communication module coupled to the processing unit and configured to wirelessly transmit application data to and from the processing unit.

According to another embodiment of the luggage article, the electronic processing module further comprises a memory unit coupled to the processing unit, the memory unit being configured to store application data associated with itinerary information of the luggage article.

According to another exemplary embodiment of the luggage article, the luggage article further comprises an interface unit configured to receive input signals for controlling the processing module to display information items on the display. This provides the advantage to directly interact with the luggage article without the need for a wireless communication device.

According to one embodiment of the luggage article, the luggage article further comprises a camera arranged in the shell and coupled to the electronic processing module, the camera being configured to take pictures of the surrounding of the luggage article. This provides the advantage of being able to generate a photographic log file of the travel along the route. The photographic information may either be used for safety reasons or for social enrichment.

According to an exemplary embodiment of the luggage article, the luggage article further comprises at least one weighing sensor being configured to measure the weight of the luggage article. This enables a direct feedback to the user when the luggage article threatens to be overpacked.

According to one embodiment of the luggage article, the luggage article further comprises an indicator panel comprising one or more indicators configured to display information related to a measuring result of the at least one weighing sensor. This facilitates the display of the weight and/or the excess of weight thresholds for the user.

According to another embodiment of the luggage article, the luggage article further comprises one or more sensors configured to measure one or more of the following parameters in the surrounding of the luggage article: temperature, acceleration, gyration, pressure, humidity, luminance. This enables to enhance a travel log of the luggage article and to track back unusual occurrences during the itinerary.

According to one of various embodiments of the luggage article, the luggage article further comprises a power supply unit coupled to the processing module and configured to supply the processing module with electric power.

According to another embodiment of the luggage article, the luggage article further comprises one or more wheels coupled to the power supply unit and being configured to convert rotational energy to electric energy for charging the power supply unit. This advantageously enables to charge the power supply unit while travelling with the luggage article, thereby minimizing the downtime of the electronic processing module.

According to one embodiment of the luggage article, the luggage article further comprises a further display arranged on the inside of the shell coupled to the electronic processing module. This aids a user in being aware of travel related context information such as advised packing and mission related instructions for optimized travel preparation.

According to an exemplary embodiment of the luggage article, the luggage article further comprises airtight compression bags arranged within the shell, and a vacuum establishing unit coupled to the airtight compression bags and configured to evacuate the airtight compression bags from air. This enables a user to compactly and safely pack the luggage article's contents.

A person skilled in the art can gather other characteristics and advantages of the disclosure from the following description of exemplary embodiments that refers to the attached drawings, wherein the described exemplary embodiments should not be interpreted in a restrictive sense.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Luggage article within the meaning of the present disclosure may comprise any mobile container designed for personal travel. In particular, luggage articles may for example comprise travel bags, backpacks, knapsacks, trunks, chests, suitcases, briefcases, trolley bags, portmanteaux, valises, tote bags, holdalls, carpetbags, carry-on baggage or similar items of baggage. These terms may be used interchangeably within the sense of this disclosure.

Figure 1:
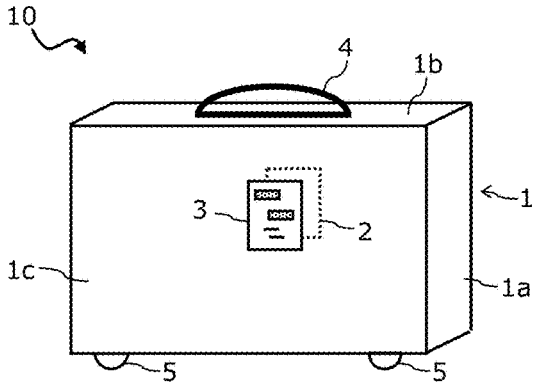
FIG. 1 shows a schematic illustration of a luggage article according to an exemplary embodiment of the present disclosure.

FIG. 1 shows a luggage article 10, particularly a luggage article 10 for use in travelling. The luggage article 10 may be used for travelling on board of aircraft, particularly in connection with intermodal travel or mixed-mode commuting.

The luggage article 10 may comprise a shell, generally denoted with the reference sign 1. The shell 1 may be a hard shell, for example made from metal or a plastics material, or a soft shell, for example made from woven fabric. The luggage article 10 in FIG. 1 is exemplarily shown as generally cuboidal in shape, with a side surface 1*a*, a top surface 1*b* and a front surface 1*c*. The top surface 1*b* may be equipped with a handle 4 such as a strap or carrying handle. The front surface 1*c* may be implemented as lid for the luggage which may be swung open to access the inner portion of the luggage article 10 enclosed by the shell 1.

The luggage article 10 may be conveniently sized for cabin, cargo or handler requirements. For example, the luggage article 10 may have outer dimensions generally complying with the standards for cabin baggage in aircraft. The luggage article 10 may be available in different sizes wherein the different sizes are complementary or matched to each other, for example, such that two luggage articles 10 of a smaller variant congruently fit onto a front surface 1*c* of a luggage article of a larger variant. That way, different luggage articles 10 of the same model series may be easily and space-savingly stacked.

The luggage article 10 may comprise an electronic processing module 2 and an electronic display 3 coupled to the electronic processing module 2. The electronic processing module 2 may be arranged inside the luggage article 10, i.e. not accessible from outside the shell 1. The display 3, on the other hand, may be integrated into one of the shell surfaces of the luggage article 10 so that graphical items may be displayed on the display 3 to be viewed from outside the shell 1. The luggage article 10 may be configured to display itinerary or travel related information on the display 3 under the control of a user of the luggage article 10.

The display 3 may for example be a liquid crystal display (LCD), a light emitting diode (LED) display, an electronic ink display, a bi-state display or any other suitable electronic display means. The display 3 may be oriented substantially planar with the respective surface of the luggage article in which the display 3 is embedded. For example, the display 3 may also be arranged on the top surface 1*b* of the luggage article, or within the handle 4.

The electronic processing module 2 may for example form an integral component with the display 3, such as in a smartphone, a handheld computer or a tablet computer. In such a case, the electronic processing module 2 and the display 3 may be configured to be connected to the luggage article 10 by means of a receptacle in one of the surfaces of the luggage article 10. The receptacle may receive the electronic processing module 2 and the display 3 in a releasably locking arrangement. It may be provided for means to monitor the presence of an electronic processing module 2 and a display 3 within the receptacle of the luggage article so that the electronic processing module 2 may only be activated when connected with a luggage article 10. The receptacle and the electronic processing module 2 may for this reason have specifically shaped corresponding male and female socket and plug parts for a form-locking engagement between the electronic processing module 2 and the luggage article 10.

It may also be possible to provide an additional display which may be attached to the luggage article 10 by means of a carabiner or a similar clasp. The additional display may have a liquid crystal display (LCD), a light emitting diode (LED) display, an electronic ink display, a bi-state display or any other suitable electronic display means equipped on both sides of the additional display.

Figure 2:
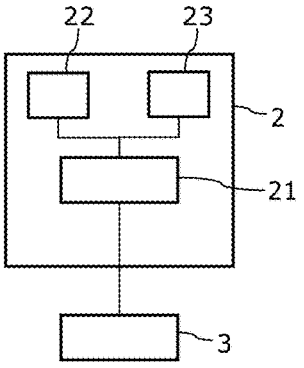
FIG. 2 shows a schematic illustration of a data processing system of a luggage article according to another exemplary embodiment of the present disclosure.

The electronic processing module 2 is shown in more detail in the schematic illustration of FIG. 2. The electronic processing module 2 may comprise a processing unit 21, for example a microprocessor, a microcontroller or a central processing unit. The electronic processing module 2 may further comprise a memory unit 22, for example a read-only memory or a random access memory, which is coupled to the processing unit 21 and which may store configuration data for the processing unit 21 and/or application data. The memory unit 22 may be configured to store application data associated with itinerary information of the luggage article 10. The application data may be transmitted to the processing unit 21 by means of a communication module 23 which is coupled to the processing unit 21 and the memory unit 22.

The communication module 23 may for example be a Bluetooth® module, an RFID module, a GPRS module, a GSM module, a UMTS module, an LTE module, a WiMax module, a WLAN module or any other suitable wireless communication module. It may also be possible to provide for more than one communication module 23 in order to have multiple communication means for transmitting data to and from the processing unit 21. The communication module 23 may be configured to wirelessly transmit application data to and from the processing unit 21.

The electronic processing module 2 may be configured to display information on the display 3. For example, the electronic processing module 2 may display itinerary related information on the display 3, such as baggage claim barcodes, flight numbers, destination information, airport information or the like. The information on the display 3 may change depending on the current location of the luggage article 10. To that end, the electronic processing module 2 may further comprise a GPS unit to determine the current location of the luggage article 10.

The electronic processing module 2 may be accessed via external means such as application software on a user equipment, for example a smartphone, a tablet PC or the like. It may be possible to provide for security means such as a PIN code or security code query in order to gain access to the electronic processing module 2. A user, for example the owner of the luggage article 10, personnel of a service provider, customs officials or other users concerned with the handling of the luggage article 10, may query the electronic processing module 2 via external access over the communication module 23 to change the application data or to show certain information items on the display 3. In order to fulfil flight security requirements, the electronic processing module 2 may be configured to be switched off or inactive during flights with an aircraft.

The communication module 23 may also serve as reception device for any other queries or signals, such as a locking request of the luggage article, an update request for flight information, an update of the stored baggage weight, any ID numbers connected with purchased travel tickets and the like.

In order to fulfil labelling requirements, the information shown on the display 3 may change from step to step along its travel to the destination so that different actors may read the respectively relevant information. The information items may be displayed as clear text, as reference numbers, as barcodes, as QR codes or similar display. In order to read out the information, handheld scanners, barcode scanners of automated luggage scanners at airports may be employed.

The display 3 may in particular show any details currently connected with a conventional paper tag displaying flight and booking information details. The display 3 may show the respective contents of such a paper tag in lifelike dimensions and appearance, so that any information can be read out using conventional infrastructure items and devices such as conventional handheld scanners or barcode readers. This facilitates the interconnectivity with legacy systems at airports and service providers, rendering the luggage article 10 to be employable in nearly every conventional environment.

By employing an electronic processing module 2 having a communication module 23 it is possible to provide for "Track & Trace" logistics, i.e. transportation service providers such as postal services or parcel shipment providers may implement automated collection and delivery via a provider platform.

Figure 3:
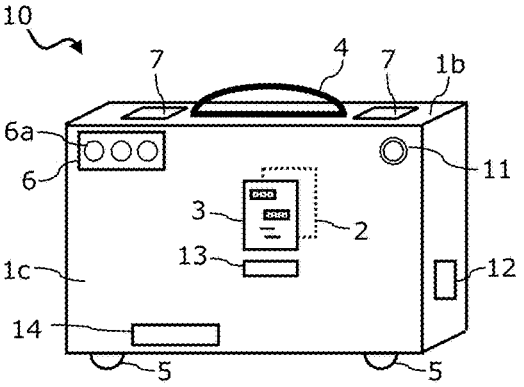
FIG. 3 shows a schematic illustration of a luggage article according to yet another exemplary embodiment of the present disclosure.

FIG. 3 shows a schematic illustration of a luggage article 10 according to another exemplary embodiment. The luggage article 10 may comprise an interface unit 13 configured to receive input signals for controlling the processing module 2 to display information items on the display 3. The interface unit 13 may for example be a fingerprint reader, a button array or a touchscreen.

The luggage article 10 may further comprise a camera 11 arranged in the shell 1 and coupled to the electronic processing module 2. The camera 11 may be configured to take pictures of the surrounding of the luggage article 10. The camera 11 may for example be coupled to the communication module 23 in order to upload taken pictures to a social media network in order to generate a travel log enriched by actual photographs of intermediate destinations along the travelling route of the luggage article 10.

Figure 4:
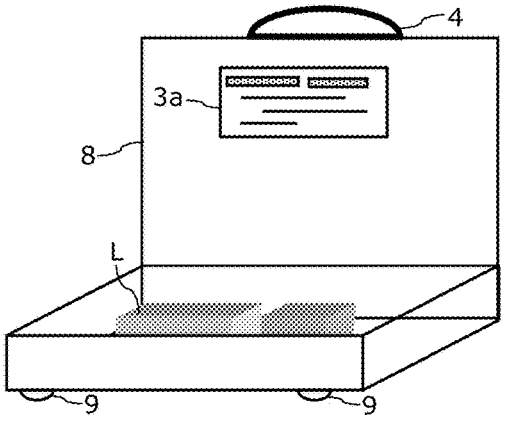
FIG. 4 shows a schematic illustration of a luggage article according to yet another exemplary embodiment of the present disclosure.

As shown in FIG. 4, the luggage article 10 may further comprise at least one weighing sensor 9 being configured to measure the weight of the luggage article 10. The weighing sensors 9 may for example be arranged on a bottom surface of the shell 1 so that the weight of the luggage article 10 may be determined while the shell lid 8 is opened. Any luggage content L may be weighed and a feedback regarding the current weight of the luggage article 10 may be given. To that end, the luggage article may comprise an indicator panel 6 comprising one or more indicators 6*a* configured to display information related to a measuring result of the at least one weighing sensor 9. The indicators 6*a* may for example be differently coloured LEDs. It may also be possible to display the actual weight value on the indicator panel 6.

In one embodiment the indicator panel 6 may also be employed to provide a tracking signal by the luggage article 10. For example, upon receipt of a location pinging signal via the communication module 23, the electronic processing module 2 may prompt the indicator panel 6 to output a visual and/or acoustical indication to the surroundings. This may enable the luggage article 10 to be found and identified more easily, for example at a baggage claim in the airport, in a freight container or cargo hold, or on an airport field.

Returning to FIG. 3, the luggage article 10 may further comprise one or more sensors 12 configured to measure one or more of the following parameters in the surrounding of the luggage article: temperature, acceleration, gyration, pressure, humidity, luminance. Any unusual conditions of the surroundings may be recorded by the sensors 12 and stored in the memory unit 21. The stored information may be used for example to track back causes of damages to the luggage article 10 after an itinerary.

The luggage article 10 may further comprise a power supply unit 14 coupled to the processing module 2 and configured to supply the processing module 2 with electric power. The power supply unit 14 may for example comprise rechargeable batteries. In order to charge those batteries, the luggage article 10 may comprise one or more wheels 5 coupled to the power supply unit 14 and being configured to convert rotational energy to electric energy for charging the power supply unit 14, or their batteries respectively. The wheels 5 may for example be actuated while moving the luggage article 10 over the ground.

The luggage article 10 may further comprise locks 7. The locks 7 may be electronically actuated. For example, the processing module 2 may electronically seal the locks 7 until a user correctly responds to a security query, for example by entering a PIN code or by answering a security question. The user may for example provide the input by means of a smartphone and wireless transmission to the luggage article 10, or by inputting the response directly to the luggage article 10 by means of the interface unit 13.

Returning to FIG. 4, the luggage article 10 may further comprise a further display 3*a* arranged on the inside of the shell 1 coupled to the electronic processing module 2. On the display 3*a* mission related information such as medical advice, telephone numbers, visa information of the destination country, weather forecast information, climatic specialties, hotel information or similar information may be shown to the user while packing the luggage article 10 with his personal belongings.

The luggage article 10 may further comprise integrated and extendable legs which may serve as stand for packing the luggage or as laptop/tablet stand.

The luggage article 10 may further comprise airtight compression bags arranged within the shell 1, and a vacuum establishing unit coupled to the airtight compression bags and configured to evacuate the airtight compression bags from air. For example, the vacuum establishing unit may be provided in the handle 4 which may be extended from the luggage article 10 in order to actuate the vacuum establishing unit. With the evacuation of the airtight compression bags the contents L of the luggage article 10 may on one hand be safeguarded from external influences, on the other hand the contents of the luggage article 10 may be compacted in order to more neatly pack the luggage.

Figure 5:
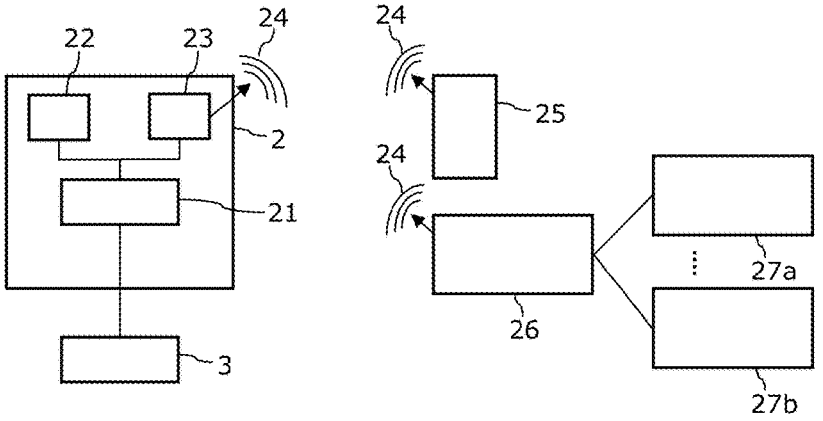
FIG. 5 shows a communication system for luggage articles according to yet another exemplary embodiment of the present disclosure.

FIG. 5 shows a schematic illustration of a communication system for luggage articles, such as the luggage articles 10 as described in conjunction with FIGS. 1 to 4. The communication system may for example comprise one or more smartphones 25 on which application software is installed that may be used to wirelessly communicate with the communication module 23 of the processing module 2. The wireless communication may be effected over a wireless communication channel 24.

The communication system comprises a management platform 26 which is configured to communicate with the electronic processing module 2 and to control the electronic processing module 2 to display information items on the display 3 of the luggage articles 10. Any communication may either directly occur between the smartphone 25 and the processing module 2 or by relaying of the management platform 26. The management platform 26 may itself be in communication with different other platforms of service providers such as airlines, transportation service providers or travel agencies.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A luggage article, comprising:

a shell;

an electronic processing module integrated with the shell; and an electronic display coupled to the electronic processing module, forming an integral component with the electronic display, and arranged on an outer surface of the shell;

wherein the electronic processing module is configured to control the display to display information items to a user of the luggage article;

wherein the electronic processing module and the electronic display are configured to be connected to the luggage article by a receptacle in a surface of the luggage article; and wherein the luggage article is provided with means to monitor presence of the electronic processing module and the electronic display within the receptacle of the luggage article so that the electronic processing module is only activated when connected with the luggage article.

2. The luggage article of claim 1, wherein the electronic processing module further comprises:

a processing unit; and a communication module coupled to the processing unit and configured to wirelessly transmit application data to and from the processing unit.

3. The luggage article of claim 2, wherein the electronic processing module further comprises:

a memory unit coupled to the processing unit, the memory unit being configured to store application data associated with itinerary information of the luggage article.

4. The luggage article of claim 1, further comprising:

an interface unit configured to receive input signals for controlling the electronic processing module to display information items on the display.

5. The luggage article of claim 1, further comprising:

a camera arranged in the shell and coupled to the electronic processing module, the camera being configured to take pictures of the surrounding of the luggage article.

6. The luggage article of claim 1, further comprising:

at least one weighing sensor being configured to measure the weight of the luggage article.

7. The luggage article of claim 6, further comprising:

an indicator panel comprising one or more indicators configured to display information related to a measuring result of the at least one weighing sensor.

8. The luggage article of claim 1, further comprising:

one or more sensors configured to measure one or more of the following parameters in the surrounding of the luggage article: temperature, acceleration, gyration, pressure, humidity, and luminance.

9. The luggage article of claim 1, further comprising:

a power supply unit coupled to the electronic processing module and configured to supply the electronic processing module with electric power.

10. The luggage article of claim 9, further comprising:

one or more wheels coupled to the power supply unit and being configured to convert rotational energy to electric energy for charging the power supply unit.

11. The luggage article of claim 1, further comprising:

a second display arranged on the inside of the shell coupled to the electronic processing module.

12. The luggage article of claim 1, further comprising:

airtight compression bags arranged within the shell; and a vacuum establishing unit coupled to the airtight compression bags and configured to evacuate air from the airtight compression bags.

13. A system for luggage articles, comprising:

at least one luggage article including a shell, an electronic processing module integrated with the shell and an electronic display coupled to the electronic processing module, forming an integral component with the electronic display, and arranged on an outer surface of the shell; and a management platform configured to communicate with the electronic processing module and to control the electronic processing module to display information items on the display of the at least one luggage article;

wherein the processing module is configured to control the electronic display to display information items to a user of the luggage article;

wherein the electronic processing module and the electronic display are configured to be connected to the luggage article by a receptacle in a surface of the luggage article; and wherein the luggage article is provided with means to monitor presence of the electronic processing module and the electronic display within the receptacle of the luggage article so that the electronic processing module is only activated when connected with the luggage article.

14. The system of claim 13, wherein the electronic processing module further comprises:

a processing unit; and a communication module coupled to the processing unit and configured to wirelessly transmit application data to and from the processing unit.

15. The system of claim 14, wherein the electronic processing module further comprises:

a memory unit coupled to the processing unit, the memory unit being configured to store application data associated with itinerary information of the luggage article.

16. A luggage article, comprising:

a shell;

an electronic processing module integrated with the shell;

an electronic display coupled to the electronic processing module, forming an integral component with the electronic display, and arranged on an outer surface of the shell, the electronic processing module configured to control the display to display information items to a user of the luggage article; and an interface unit configured to receive input signals for controlling the electronic processing module to display information items on the display;

wherein the electronic processing module and the electronic display are configured to be connected to the luggage article by a receptacle in a surface of the luggage article; and wherein the luggage article is provided with means to monitor the presence of the electronic processing module and the electronic display within the receptacle of the luggage article so that the electronic processing module is only activated when connected with the luggage article.

17. The luggage article of claim 16, further comprising:

a camera arranged in the shell and coupled to the electronic processing module, the camera being configured to take pictures of the surrounding of the luggage article.

18. The luggage article of claim 16, further comprising:

at least one weighing sensor being configured to measure the weight of the luggage article.

19. The luggage article of claim 16, further comprising:

a power supply unit coupled to the electronic processing module and configured to supply the electronic processing module with electric power.

20. The luggage article of claim 19, further comprising:

one or more wheels coupled to the power supply unit and being configured to convert rotational energy to electric energy for charging the power supply unit.

* * * * *